US012246881B2

(12) United States Patent
Turner

(10) Patent No.: US 12,246,881 B2
(45) Date of Patent: Mar. 11, 2025

(54) MODULAR SHIPPING CONTAINER

(71) Applicant: TW AMERICA INC., Romulus, MI (US)

(72) Inventor: Todd T. Turner, Corydon, IN (US)

(73) Assignee: TW AMERICA INC., Romulus, MI (US)

( * ) Notice: Subject to any disclaimer, the term of this patent is extended or adjusted under 35 U.S.C. 154(b) by 217 days.

(21) Appl. No.: 18/142,337

(22) Filed: May 2, 2023

(65) Prior Publication Data

US 2024/0367856 A1 Nov. 7, 2024

(51) Int. Cl.

*B65D 19/06* (2006.01)
*B65D 21/02* (2006.01)
*B65D 21/08* (2006.01)

(52) U.S. Cl.

CPC ..... *B65D 21/083* (2013.01); *B65D 19/06* (2013.01); *B65D 21/0204* (2013.01); *B65D 2519/00273* (2013.01); *B65D 2519/00293* (2013.01); *B65D 2519/00323* (2013.01); *B65D 2519/00497* (2013.01); *B65D 2519/00567* (2013.01); *B65D 2519/0087* (2013.01)

(58) Field of Classification Search

CPC ..... B65D 21/083; B65D 21/08; B65D 19/06; B65D 2519/00746; B65D 2519/00766; B65D 2519/00761; B65D 2519/00323; B65D 2519/00293; B65D 2519/00273; B65D 88/005; B65D 19/12; B65D 21/0204; B65D 19/40

USPC ..... 206/600, 386; 220/4.27, 4.28; 108/56.1

See application file for complete search history.

(56) References Cited

U.S. PATENT DOCUMENTS 4,993,330 A * 2/1991 Yen ..... B65D 19/0095 108/56.1
5,094,175 A * 3/1992 Christie ..... B65D 19/0075 108/57.1
5,310,063 A * 5/1994 Skolasinski ..... B65D 19/18 206/386
5,483,899 A * 1/1996 Christie ..... B65D 19/0073 108/901
6,234,087 B1 * 5/2001 Brown ..... B65D 19/004 108/56.1
D672,960 S 12/2012 Turner
D672,961 S 12/2012 Turner
(Continued)

*Primary Examiner* — Steven A. Reynolds
(74) *Attorney, Agent, or Firm* — NOTARO, MICHALOS & ZACCARIA P.C.

(57) ABSTRACT

A modular shipping container has a base formed from a central portion, a first end portion, a second end portion, two sidewalls and two end walls. The central portion includes a rectangular planar area with perpendicular base sidewalls extending upward on two first opposing sides of the generally rectangular planar area, and at least two wings extending downward from each of two second opposing sides. A male latch portion is provided extending upward from each of the at least two wings on each of the second opposing sides of the generally rectangular planar area. The first end portion and the second end portion each includes a generally rectangular planar area with perpendicular base sidewalls extending upwards on three sides and having at least two female latch portions in the rectangular planar area along a fourth side. Each female latch portion mates with an associated one of the male latch portions.

10 Claims, 11 Drawing Sheets

(56) References Cited

U.S. PATENT DOCUMENTS

| | | | | |
|---|---|---|---|---|
| 8,434,618 | B2 | 5/2013 | Mitchell | |
| 8,950,612 | B2 | 2/2015 | Turner | |
| 9,422,082 | B2 | 8/2016 | Nolan | |
| 9,731,864 | B2 | 8/2017 | Turner | |
| D802,926 | S | 11/2017 | Turner | |
| 9,919,832 | B2 | 3/2018 | Mitchell | |
| D816,997 | S | 5/2018 | Turner | |
| 9,957,078 | B2 | 5/2018 | Turner | |
| 10,407,212 | B2 | 9/2019 | Turner | |
| 10,723,503 | B2 | 7/2020 | Turner | |
| 10,815,028 | B1 * | 10/2020 | Turner | E01C 5/005 |
| 10,939,676 | B1 * | 3/2021 | Harter | E04G 5/10 |
| D948,218 | S | 4/2022 | Turner | |
| 2008/0127865 | A1 * | 6/2008 | Tung-Cheng | B65D 19/12 108/56.3 |
| 2009/0205169 | A1 | 8/2009 | Nolan | |
| 2011/0108549 | A1 | 5/2011 | Mitchell | |
| 2013/0270263 | A1 | 10/2013 | Turner | |
| 2015/0336709 | A1 * | 11/2015 | Hsiao | B65D 19/0026 206/386 |
| 2016/0068301 | A1 | 3/2016 | Mitchell | |
| 2016/0075464 | A1 | 3/2016 | Turner | |
| 2016/0083138 | A1 | 3/2016 | Turner | |
| 2016/0090208 | A1 * | 3/2016 | Turner | B65D 19/06 403/326 |
| 2017/0305597 | A1 | 10/2017 | Turner | |
| 2018/0208349 | A1 | 7/2018 | Turner | |
| 2018/0362211 | A1 * | 12/2018 | Su | B65D 21/083 |
| 2019/0344929 | A1 | 11/2019 | Turner | |
| 2021/0253301 | A1 * | 8/2021 | Turner | B65D 19/06 |
| 2021/0354876 | A1 * | 11/2021 | Turner | B65D 19/18 |
| 2023/0028969 | A1 | 1/2023 | Turner | |

* cited by examiner

MODULAR SHIPPING CONTAINER

FIELD

This disclosure relates generally to shipping containers made of multiple components that can be re-arranged and interconnected into a variety of different sizes.

BACKGROUND

For many years, industries dealing in bulk goods have utilized returnable shipping containers. The use of the conventional shipping container, however, presents a number of disadvantages to the transportation, shipping, agricultural, retail, and handling industry. In particular, the conventional shipping container is typically created from a single mold and thus often comprises only a single piece of plastic that has only a single pre-defined length. This is a significant disadvantage because the length of a conventional shipping container cannot be changed to accommodate various types of bulk goods. Rather, industries dealing in bulk goods have had to acquire and store numerous conventional shipping containers having multiple lengths.

Moreover, it is expensive to manufacture a conventional shipping container because the process typically requires an enormous costly press to inject the plastic into one of a large inventory of differently-sized large molds and compress the material into the desired shape and size.

Accordingly, there is a significant need for a variable length modular shipping container that overcomes the foregoing problems.

BRIEF DESCRIPTION OF THE DRAWINGS

The following detailed description, given by way of example and not intended to limit the present disclosure solely thereto, will best be understood in conjunction with the accompanying drawings in which.

DETAILED DESCRIPTION

In the present disclosure, like reference numbers refer to like elements throughout the drawings, which illustrate various exemplary embodiments of the present disclosure.

Figure 1:
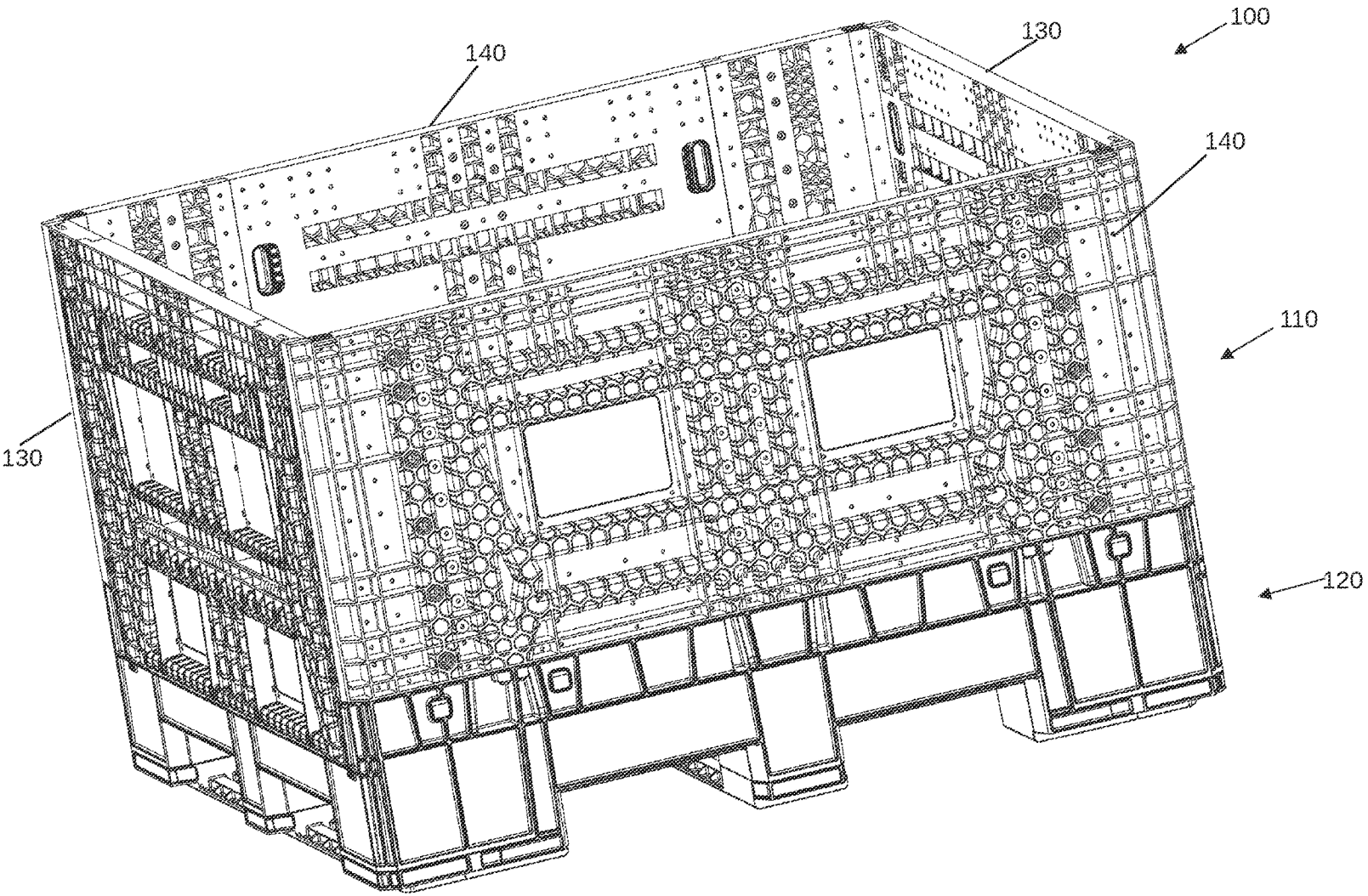
FIG. 1 is a perspective view of a modular variable-length container according to the present disclosure.
Figure 2:
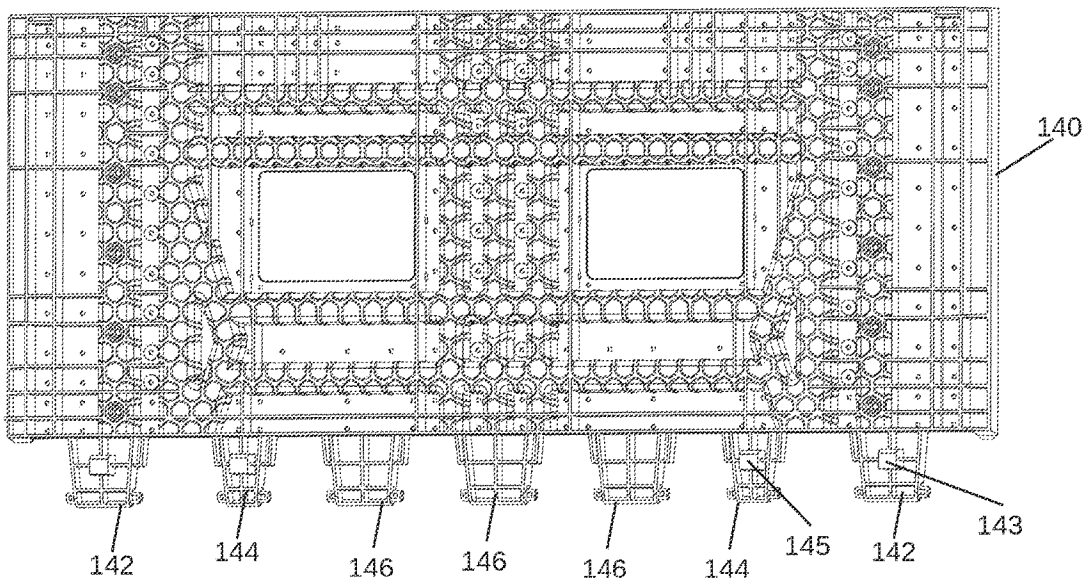
FIG. 2 is a view of sidewalls for the modular variable-length container according to the present disclosure.
Figure 2:
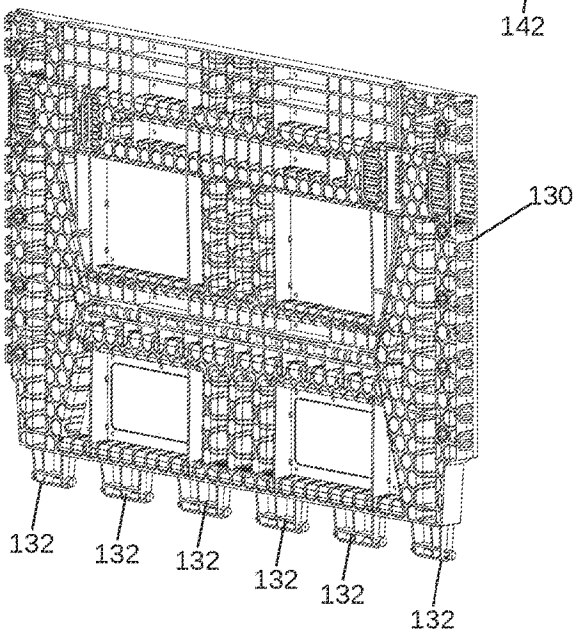

Referring now to FIG. 1, a modular shipping container 100 is shown which includes an upper portion 110 and a base 120. The upper portion 110 consists of two end-walls 130 and two sidewalls 140. When assembled, the modular shipping container 100 has a shape of a rectangular cuboid shape with one open face. As shown in FIG. 2, each end-wall 130 has a series of tabs 132 on a lower portion thereof that fit into corresponding slots 312 (FIG. 3) on the base 120. Each sidewall 140 also has tabs 142, 144, 146 which fit into corresponding slots 374, 372, 370, respectively, (FIG. 3) on the base 120. Tab 142 includes an extension 143 that fits into an aperture 375 associated slot 374, and tab 144 includes an extension 145 that fits into an aperture 373 in an associated slot 372 in order to provide a snap-fit connection and securely hold the sidewall 140 in place. The sidewalls 140 may be secured to the end-walls 130 via spring-loaded tabs within an internal slot in either the sidewall 140 or the end-wall 130 that fits into a mating slot on the other of the sidewall 140 or the end-wall 130 at an upper portion of each.

Figure 3:
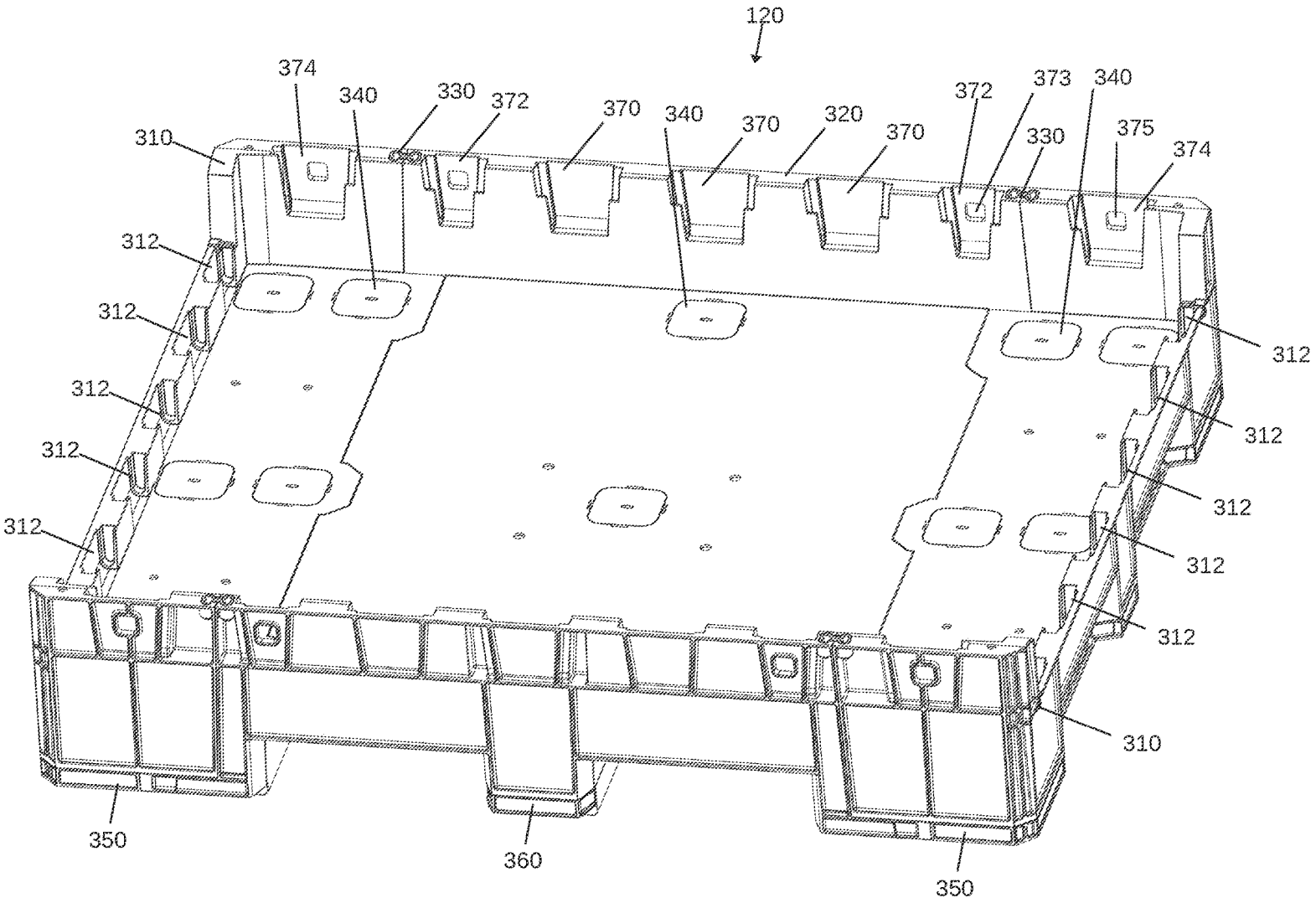
FIG. 3 is a perspective view of an assembled base for the modular variable-length container according to the present disclosure.
Figure 4:
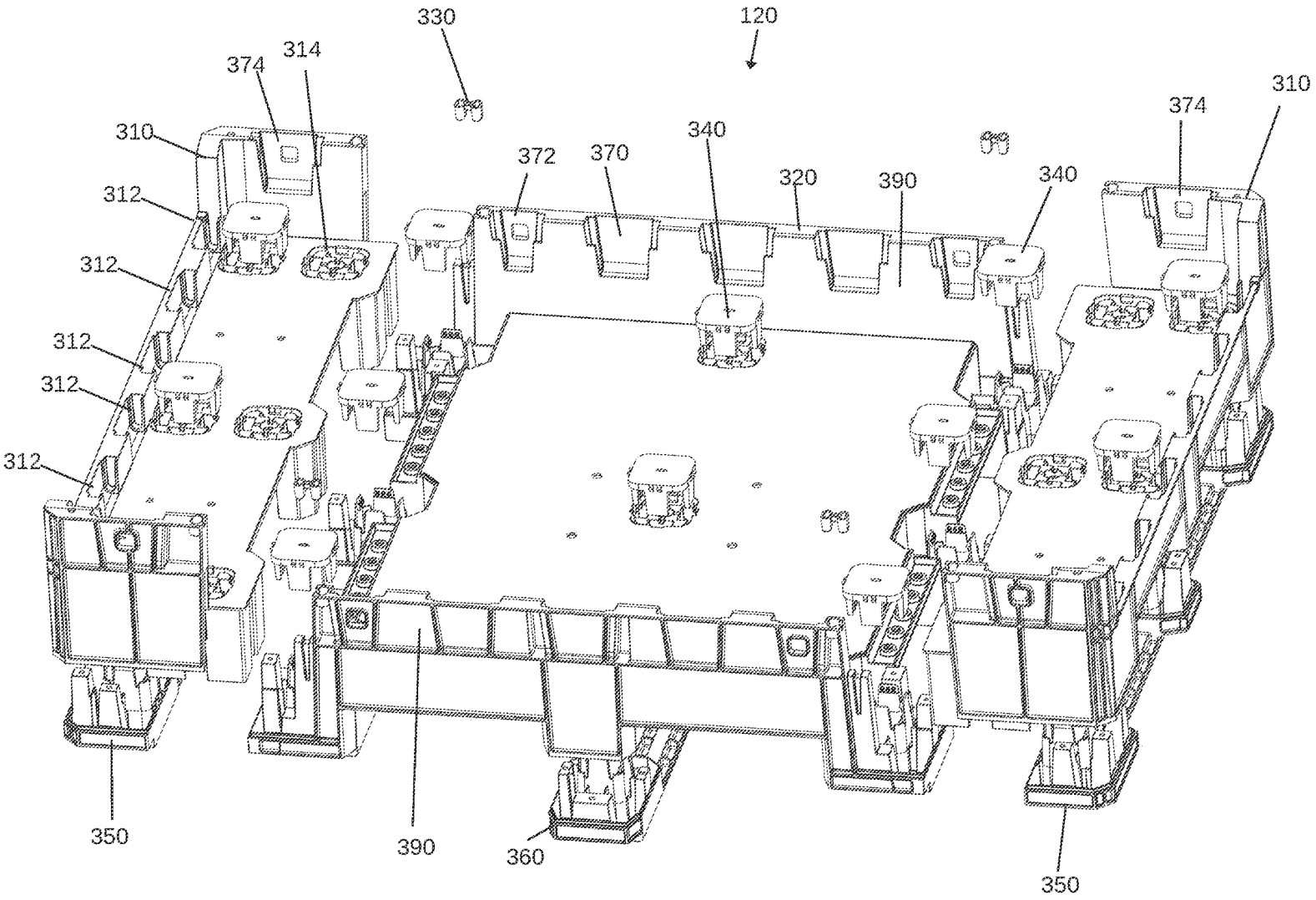
FIG. 4 is a top perspective exploded view of the base for the modular variable-length container according to the present disclosure.
Figure 5:
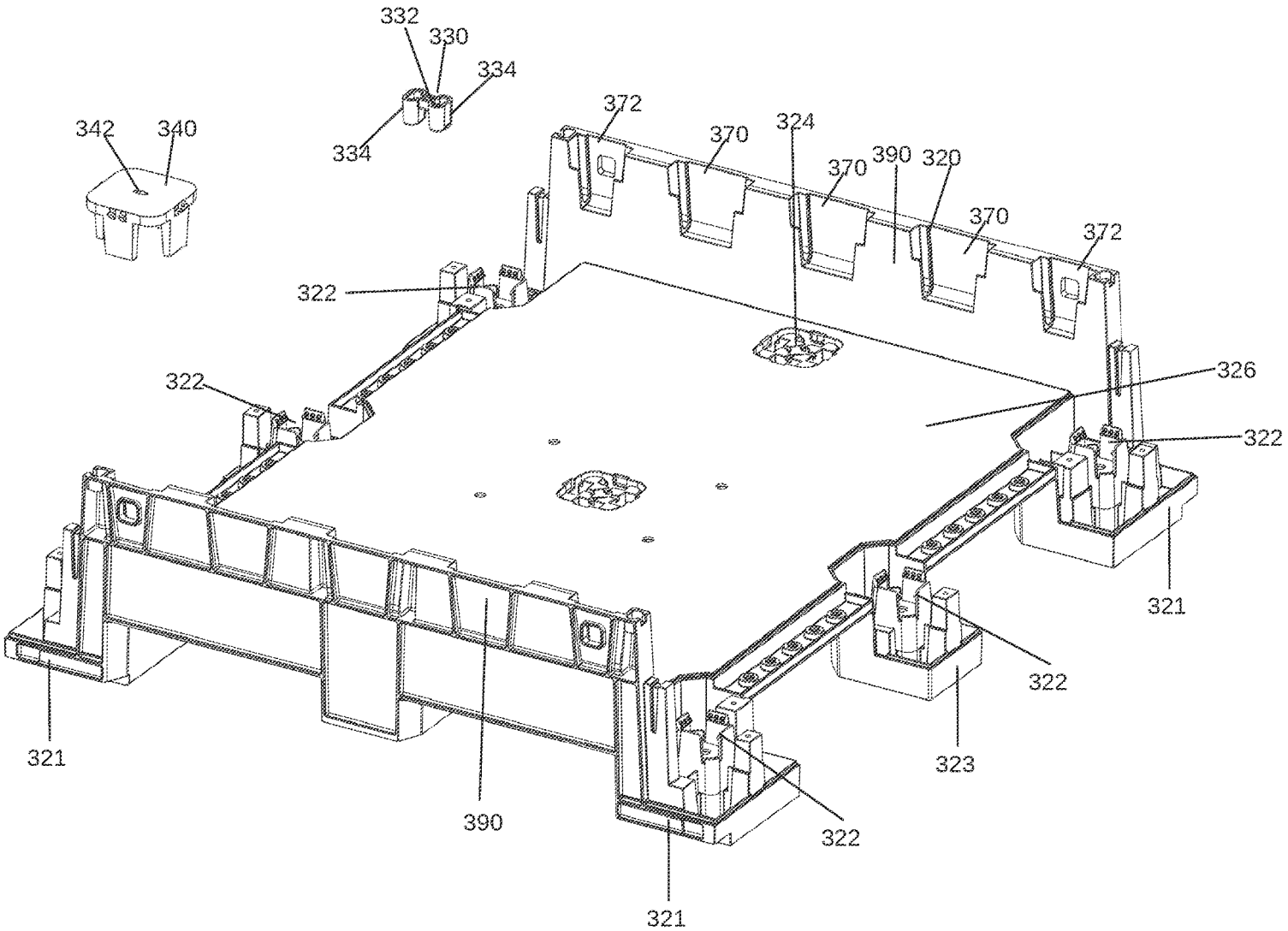
FIG. 5 is a view of a center portion of the base and other components for the modular variable-length container according to the present disclosure.

Referring now to FIGS. 3 and 4, the base 120 consists of a center portion 320 of fixed size and two variably sized end portions 310, along a center bottom member 360 and two end bottom members 350. The center bottom member 360 and the end bottom members 350 are snap fit to the center portion 320 and to each corresponding one of the end portions 310 as explained with respect to FIGS. 11A to 11C. The two end portions 310 are similarly snap-fit to the center portion 320. A cover 340 is provided over each snap-fit connection in order to protect the connection, provide a smooth surface, and to optionally provide drainage through an aperture 342 (FIG. 5) therein. Dogbone members 330 may also be provided to help secure the two end portions 310 to the center portion 320. As shown in FIG. 5, each dogbone member 330 includes a central portion 332 and two downward extensions 334 which fit into adjacent slots on the end portion 310 and center portion 320 (see FIG. 3).

Referring now to FIG. 5, the center portion 320, the cover 340, and a dogbone member 330 are shown separated from other parts. Center portion 320 includes a central platform area 326 (a generally rectangular planar area), perpendicular base sidewalls 390 extending upward on two first opposing sides of the central platform area 326, four outer wing sections 321, and, preferably, two inner wing sections 323. Each outer wing section 321 and each optional inner wing section 323 includes a male latch portion 322 for mating with an associated female latch portion on the end portions 310 (see, e.g., FIG. 6). Three female latch portions 324 are preferably provided along the center line of center portion 320, for mating with associated male latch portions 322 on the center bottom member 360 (FIG. 7). In some cases, the number of female latch portions 324 provided along the center line of center portion 320 and the corresponding male latch portions 322 on the center bottom member 360 may be less.

Figure 6:
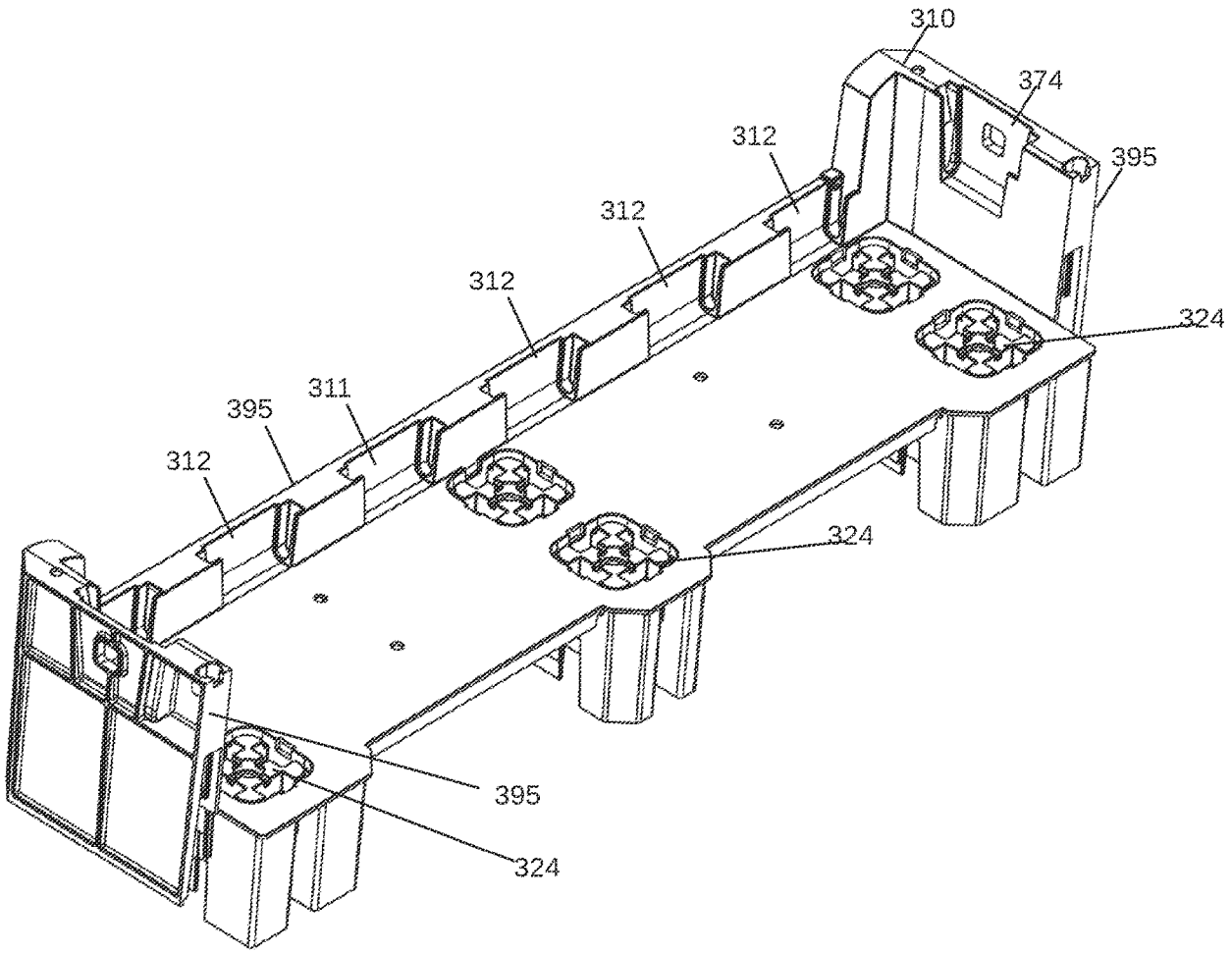
FIG. 6 is a view of a first embodiment of an end portion for the base for the modular variable-length container according to the present disclosure.
Figure 7:
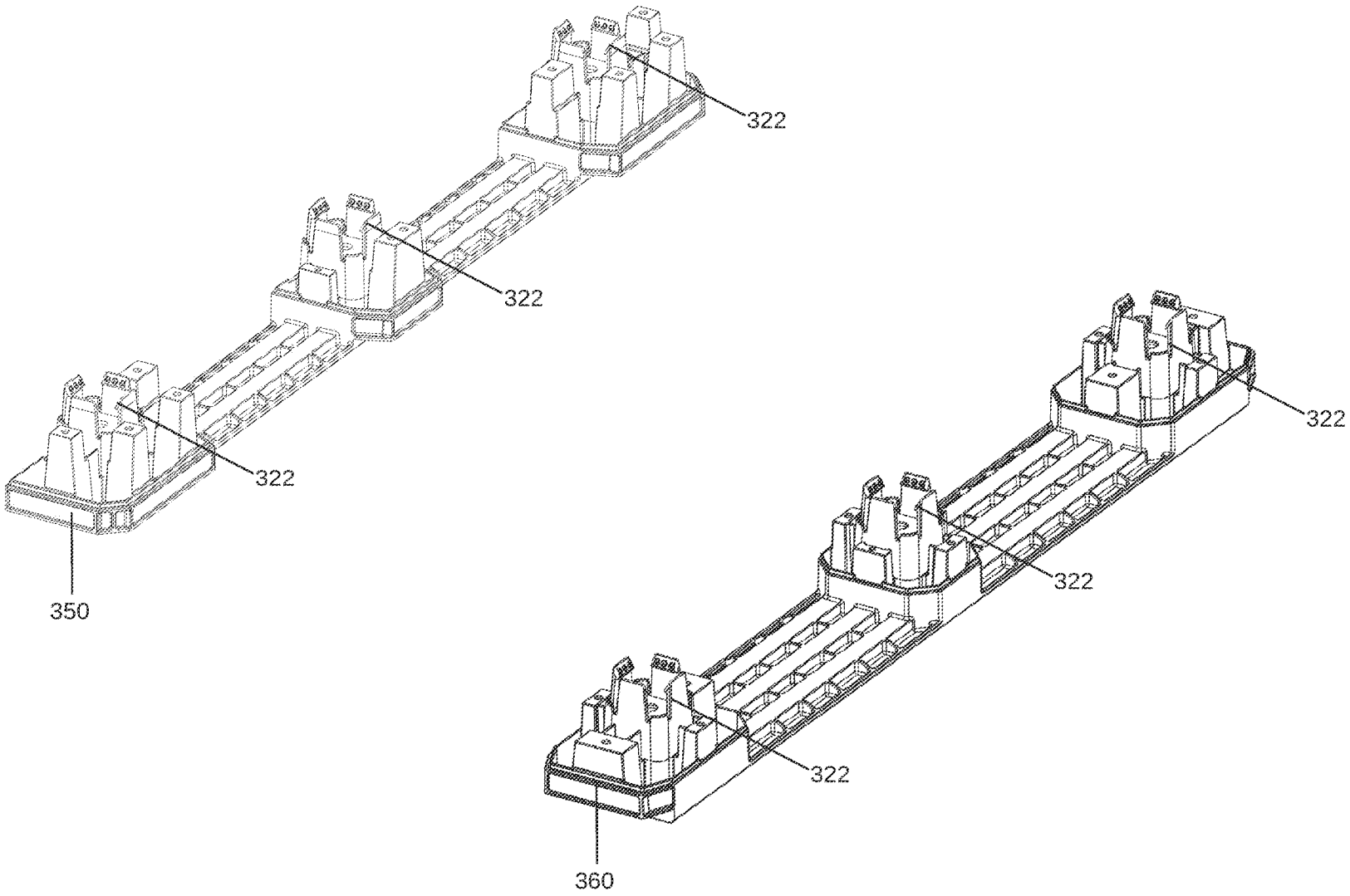
FIG. 7 is a view of bottom supports for the base for the modular variable-length container according to the present disclosure.

Referring now to FIG. 6, a first embodiment of an end portion 310 is shown having a central platform area 315 (a generally rectangular planar area), perpendicular base sidewalls 399 extending upward on three sides of the central platform area 315, two rows of three female latch portions 324. In some cases, only two female latch portions 324 may be necessary in each row. The inner row of female latch portions 324 is provided for mating with a corresponding one of the male latch portions 322 on the center portion 320. The outer row of female latch portions 324 is optional and is provided for mating with male latch portions on an associated end bottom member 350 (FIG. 7).

Perspective right top views of the center bottom member 360 and end bottom member 350 are shown in FIG. 7 to show that each includes three male latch portions 322, one at each end thereof and one in a central position. The male latch portions 322 on the center bottom member 360 mate with the female latch portions 324 on the center portion 320. The male latch portions 322 on each end bottom member 350 mate with the female latch portions 324 on the associated end portion 310.

Figure 8:
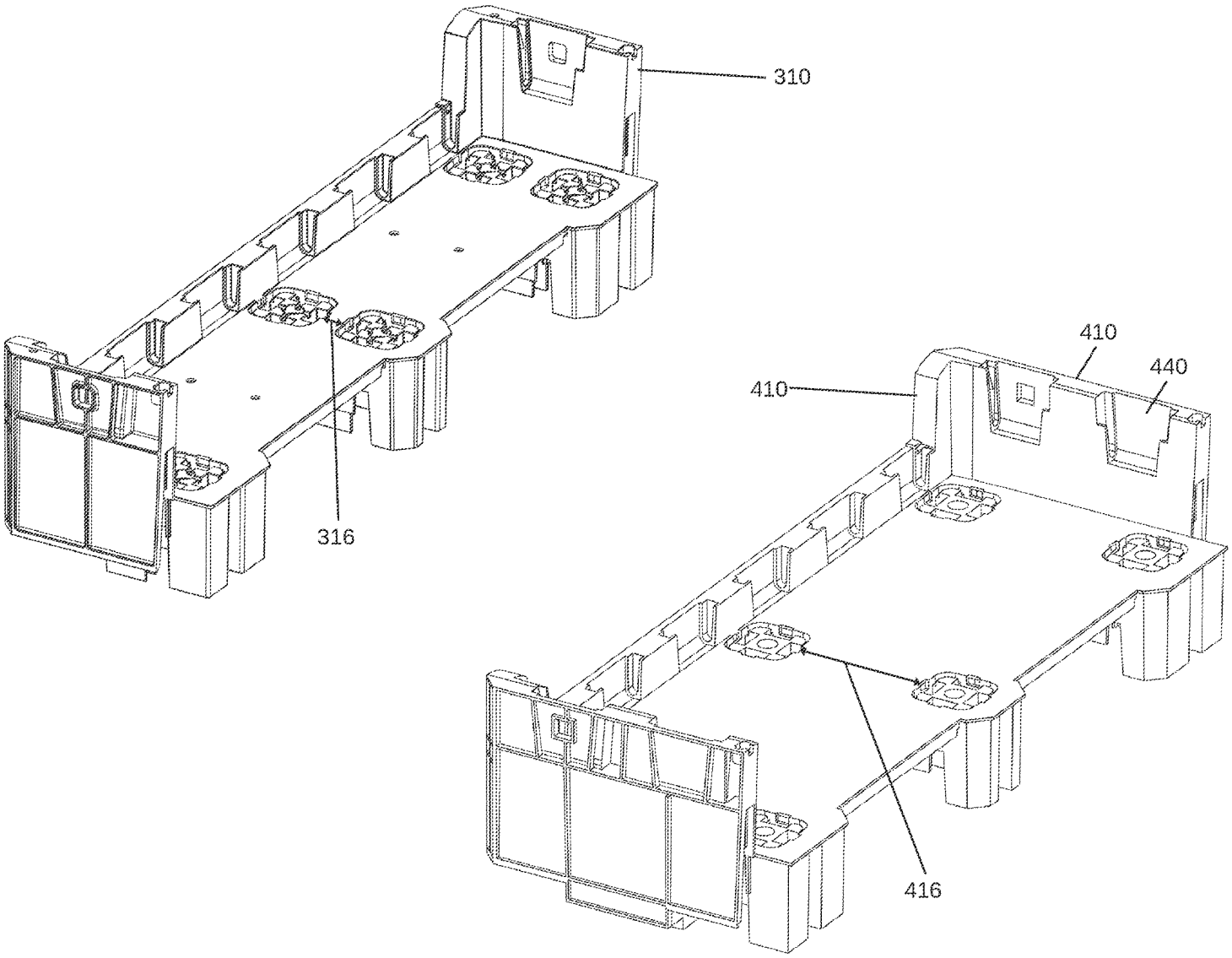
FIG. 8 is a view of the first embodiment and a second embodiment of the end portions for the base for the modular variable-length container according to the present disclosure.
Figure 9:
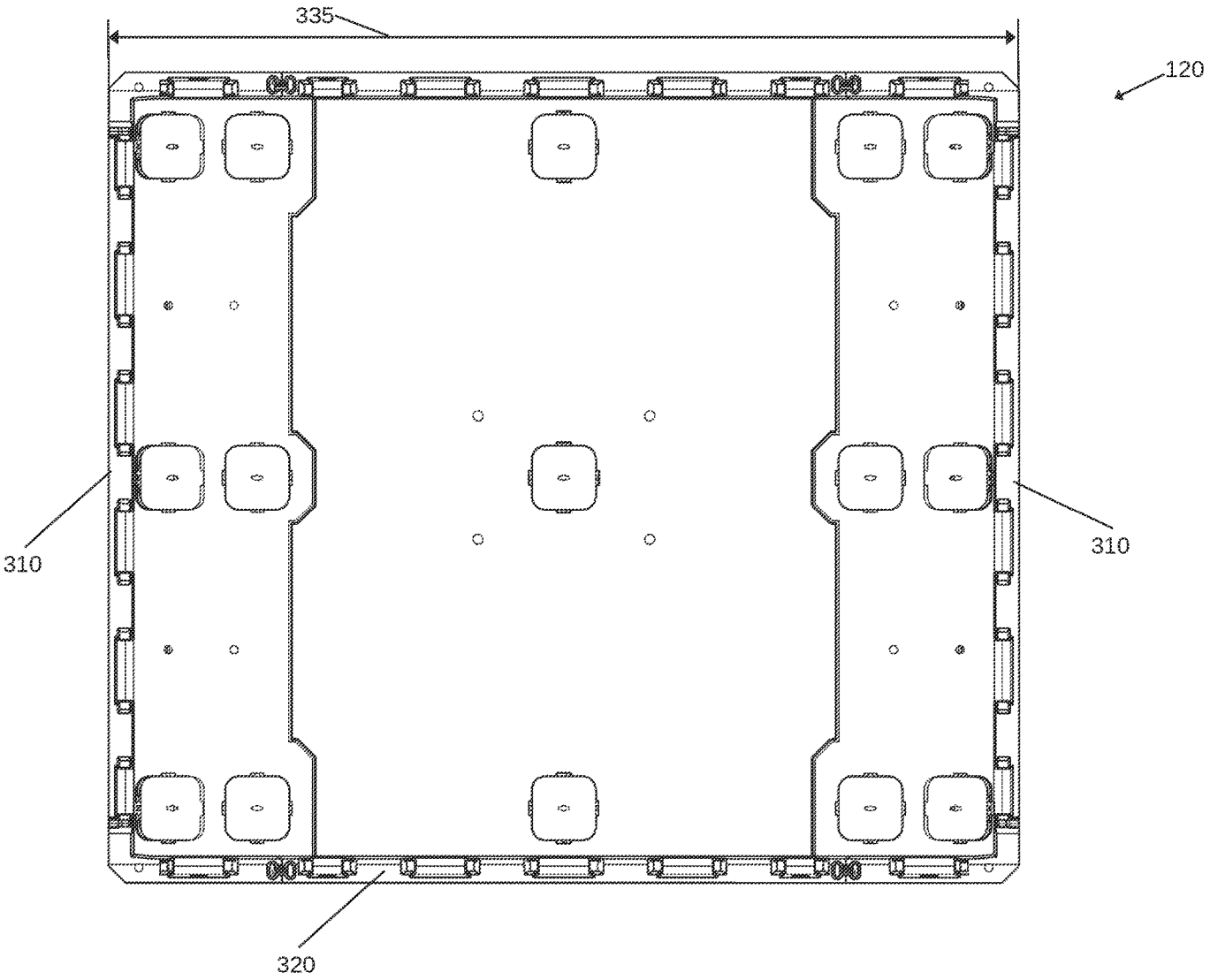
FIG. 9 is a top view of the base for the modular variable-length container using the first embodiment of end portions according to the present disclosure.
Figure 10:
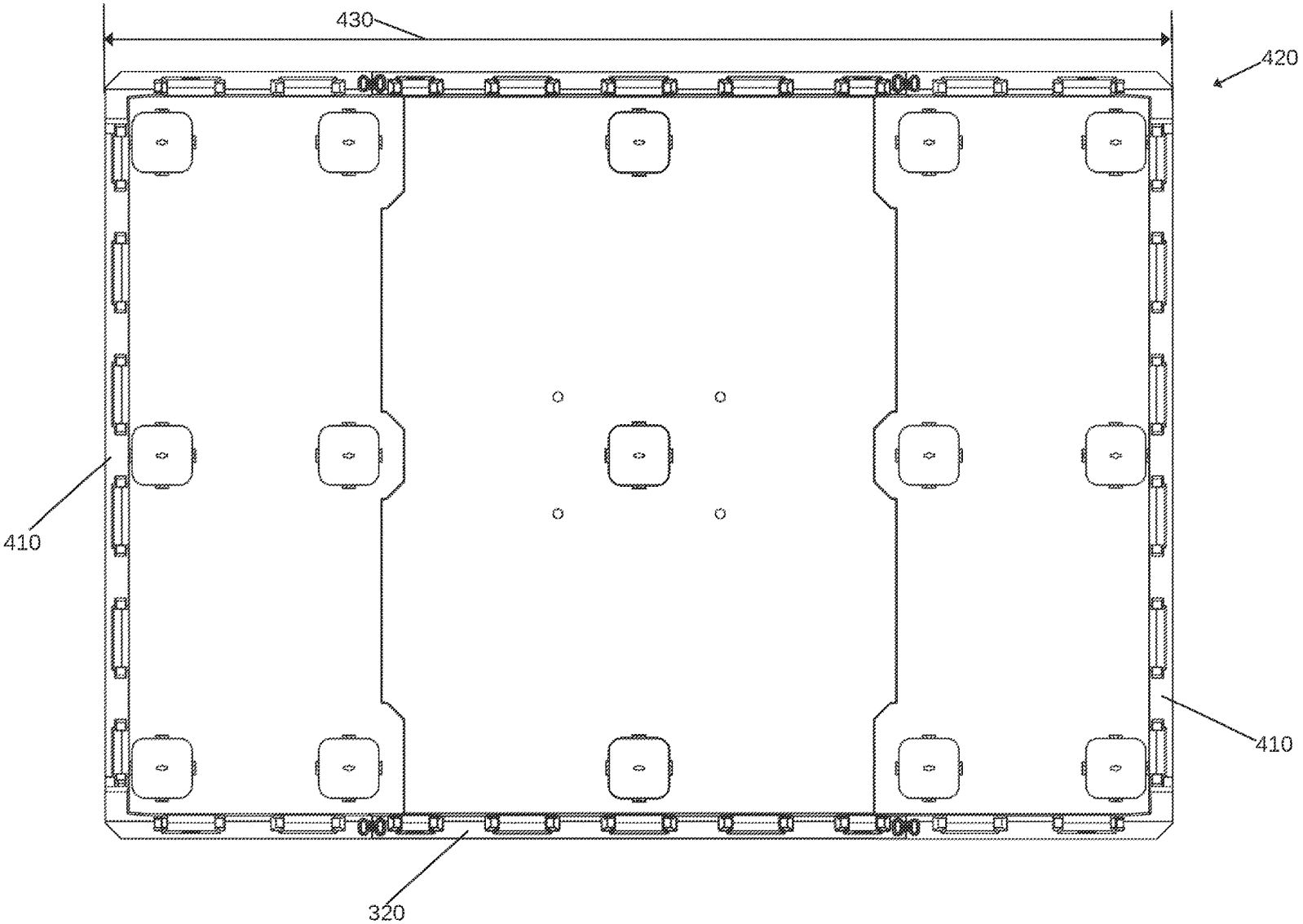
FIG. 10 is a top view of the base for the modular variable-length container using the second embodiment of end portions according to the present disclosure.

The modular shipping container disclosed herein provides a secure assembly which can be changed in length by changing only the two end portions 310 (and the two sidewalls 140). As shown in FIG. 8, two alternative end portions are shown. A first end portion 310 has a spacing between the inner and outer rows of female latch portions corresponding to ref. no. 316. An overhead view of an assembled base 120 with two end portions 310 is shown in FIG. 9 having a length 335. A second end portion 350 has a spacing between the inner and outer rows of female latch portions corresponding to ref. no. 416. Second end portion 410 also includes an additional slot 440 (for accommodating a side panel having an additional mating tab). An overhead view of an assembled base 420 with two end portions 210 is shown in FIG. 10 having a length 335. As evident, the spacing 416 is much greater than the spacing 316, so that the base 420 (FIG. 10) has a length 430 that is much greater than the length of base 120 (FIG. 9). The shipping container of the present disclosure provides a flexible solution for different sized shipping containers which needs only two different parts (two side panels and two end portions) to be changed in order to change the size of such shipping container.

Figure 11A:
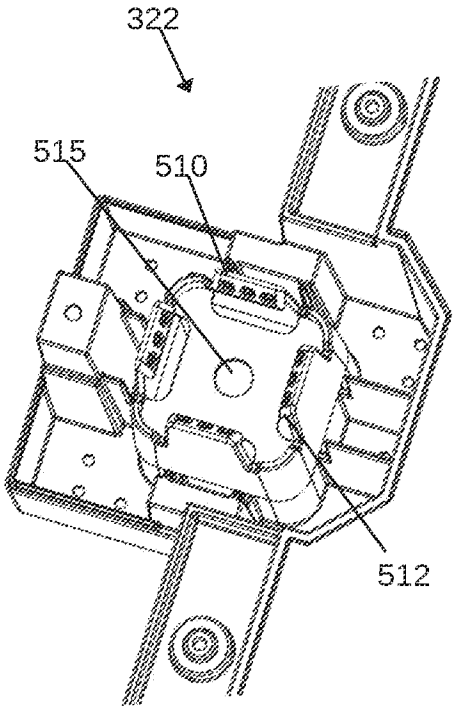
FIGS. 11A, 11B and 11C are cutaway views of the lower portion, upper portion and connected portions of the connectors according to the present disclosure.
Figure 11B:
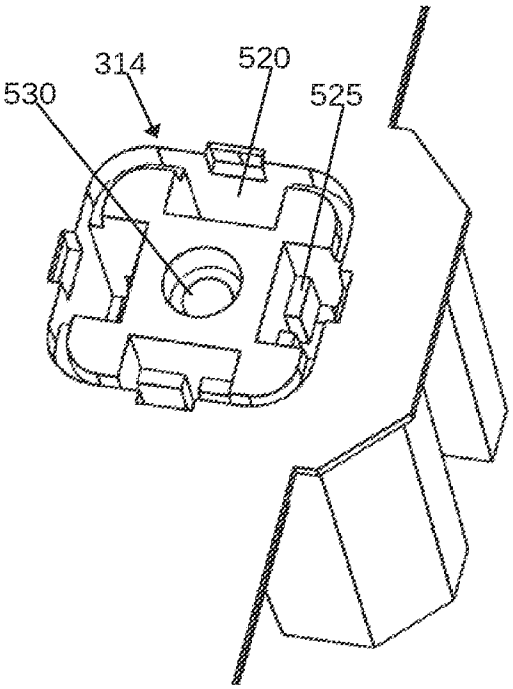
Figure 11C:
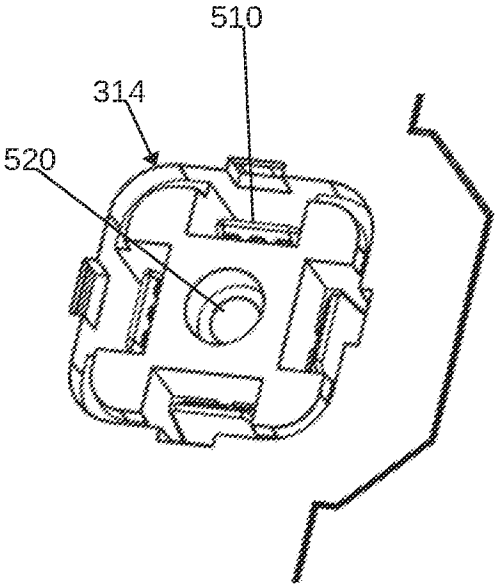

Referring now to FIG. 11A, each male latch portion 322 includes four spring members 510, with each spring member 510 having a male latch surface 512 at an end thereof. An aperture 515 is preferably provided in a central portion of each male latch portion 322. As shown in FIG. 11B, each female latch portion 314 include four slots 520, each slot including female latch surface 525. An aperture 530 is preferably provided at a central portion of each female latch portion 314. FIG. 11C shows the male latch portion 322 installed into the female latch portion 314, with each male latch surface 512 snap fit over a corresponding one of the female latch portions 314 in order to form a very secure connection between the associated parts (e.g., the end portion 310 and center portion 320, each end portion 310 and the associated end bottom member 350, or the center portion 320 and the center bottom member 360. In addition, by providing corresponding apertures 515, 530 in the male latch portion 322 and the female latch portion 324 (and the aperture 342 in cover 340), drainage is provided in multiple places in the surface of base 120.

The modular shipping container of the present disclosure is much more affordable and simpler to manufacture than conventional containers because significantly smaller molds and presses can be used to manufacture the different component parts. The modular shipping container provide market adaptability because of the versatility to re-arrange the parts into a variety of configurations of different lengths by only replacing the end portions and sidewalls to accommodate the particular requirements of a user. The modular shipping container of the present disclosure is also less burdensome for manufacturers because there is lower risk of defects when manufacturing smaller parts and because manufacturers do not have to maintain a large inventory of differently-sized large molds. Finally, the modular shipping container of the present disclosure provides manufacturers with more discrete control over material properties of the final assembled shipping container product because different resins and materials can be used for the different modular parts.

Although the present disclosure has been particularly shown and described with reference to the preferred embodiments and various aspects thereof, it will be appreciated by those of ordinary skill in the art that various changes and modifications may be made without departing from the spirit and scope of the disclosure. It is intended that the appended claims be interpreted as including the embodiments described herein, the alternatives mentioned above, and all equivalents thereto.

What is claimed is:

1. A modular shipping container, comprising:

a base formed from a central portion, a first end portion, and a second end portion;

wherein the central portion includes a generally rectangular planar area with perpendicular base sidewalls extending upward on two first opposing sides of the generally rectangular planar area, and at least two wings extending downward from each of two second opposing sides of the generally rectangular planar area, the two first opposing sides orthogonal to the second opposing sides, a male latch portion provided extending upward from each of the at least two wings on each of the second opposing sides of the generally rectangular planar area;

wherein the first end portion and the second end portion each includes a generally rectangular planar area with perpendicular base sidewalls extending upwards on three sides and having at least two female latch portions in the generally rectangular planar area along a fourth side, each female latch portion positioned to mate with an associated one of the male latch portions; and wherein when the male latch portions on each of the at least two wings on one of the second opposing sides of the generally rectangular planar area of the central portion are mated with corresponding female latch portions on the first end portion and the male latch portions on each of the at least two wings on the other of the second opposing sides of the generally rectangular planar of the central portion are mated with a corresponding one of the female latch portions on the second end portion, the base is formed having a base rectangular planar area consisting of the generally rectangular planar area of the central portion and the generally rectangular planar areas of each of the first end portion and the second end portion, the base having base sidewalls on all four sides of the base rectangular planar area.

2. The modular shipping container of claim 1, further comprising:

two end walls and two sidewalls, each of the end walls and each of the sidewalls having tabs along one side thereof, the tabs adapted to fit into associated slots in the perpendicular base sidewalls to form a rectangular cuboid shape with one open face.

3. The modular shipping container of claim 1, wherein the first end portion and the second end portion has at least two female latch portions in the generally rectangular planar area along a side opposite to the fourth side, and further comprising two end bottom members having at least two male latch portions facing upwards positioned to mate with an associated one of the female latch portions on an associated one of the first end portion and the second end portion.

4. The modular shipping container of claim 1, wherein the central portion has at least two female latch portions in a central portion of the generally rectangular planar area, and further comprising a center bottom member having at least two male latch portions facing upwards positioned to mate with an associated one of the female latch portions on the center portion.

5. The modular shipping container of claim 1, further comprising dogbones for coupling the perpendicular base sidewalls of the center portion to adjacent perpendicular base sidewalls of each of the first end portion and the second end portion.

6. The modular shipping container of claim 1, further comprising covers for mounting over each of the female latch portions.

7. The modular shipping container of claim 6, wherein each cover includes a central aperture.

8. The modular shipping container of claim 2, wherein each end wall is secured to each adjacent sidewall via a slot in one of the end wall and the adjacent sidewall and a spring-loaded tab mounted in another of the end wall and the adjacent sidewall.

9. The modular shipping container of claim 2, wherein at least one of the tabs on each of the sidewalls includes an extension that fits into an associated aperture in the associated slot in the perpendicular base sidewall to securely hold each of the sidewalls to the base.

10. The modular shipping container of claim 1, wherein each male latch portion has four spring members with a male latch surface at an end thereof, and each female latch portion has four slots with a female latch surface, and wherein, when the male latch portion is inserted into the female latch portion, the male latch surface engages with the female latch surface to provide a secure bond.

* * * * *